US011727887B2

(12) United States Patent
Baek et al.

(10) Patent No.: US 11,727,887 B2
(45) Date of Patent: Aug. 15, 2023

(54) ELECTRONIC DEVICE

(71) Applicant: Samsung Display Co., Ltd., Yongin-si (KR)

(72) Inventors: Yunki Baek, Suwon-si (KR); Taehyeong An, Hwaseong-si (KR); Joon-Chul Goh, Suwon-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 0 days.

(21) Appl. No.: 17/722,699

(22) Filed: Apr. 18, 2022

(65) Prior Publication Data

US 2023/0103193 A1 Mar. 30, 2023

(30) Foreign Application Priority Data

Sep. 27, 2021 (KR) ..... 10-2021-0127336

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/0278* (2013.01); *G09G 2310/061* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 10,049,642 | B2 | 8/2018 | Ansari | |
| 10,825,419 | B2 | 11/2020 | Chu et al. | |
| 2019/0253662 | A1* | 8/2019 | Kim | H04N 7/0127 |
| 2020/0193915 | A1* | 6/2020 | Noh | G09G 3/3266 |
| 2022/0148522 | A1* | 5/2022 | Jang | G09G 3/3291 |

* cited by examiner

*Primary Examiner* — Nitin Patel
*Assistant Examiner* — Amen W Bogale
(74) *Attorney, Agent, or Firm* — Innovation Counsel LLP

(57) ABSTRACT

Provided is an electronic device according to an embodiment of the inventive concept may include a display panel including a plurality of pixels respectively connected to a plurality of data lines and a plurality of scan lines, a data driving circuit connected to the plurality of data lines, a scan driving circuit connected to the plurality of scan lines, and a driving controller generating image data, and controlling the data driving circuit and the scan driving circuit to display a plurality of frames at a first frequency on the display panel based on the image data, wherein at least one of the plurality of frames includes an effective interval during which an image is transmitted, a blanking interval during which the image is not transmitted, and a refresh interval operating at a second frequency different from the first frequency.

18 Claims, 9 Drawing Sheets

ELECTRONIC DEVICE

CROSS-REFERENCE TO RELATED APPLICATIONS

This U.S. non-provisional patent application claims priority under 35 U.S.C. § 119 to Korean Patent Application No. 10-2021-0127336, filed on Sep. 27, 2021, the entire contents of which are hereby incorporated by reference.

BACKGROUND

The present disclosure herein relates to an electronic device of which display quality is enhanced.

An organic light emitting display device among display devices displays an image using an organic light emitting diode emitting light by recombination of electrons and holes. The organic light emitting display has advantages of fast response speed and low power consumption.

The organic light emitting display device is provided with pixels connected to data lines and scan lines. Typically, each of the pixels includes an organic light emitting diode and a pixel circuit for controlling a current amount flowing through the organic light emitting diode. The pixel circuit controls the current amount flowing from a first driving voltage to a second driving voltage via the organic light emitting diode in response to a data signal. Here, light of a prescribed luminance is generated in response to the current amount flowing through the organic light emitting diode.

As a field of use of a display device is recently diversified, a plurality of different images may be concurrently displayed on one display device. Therefore, a technology is required to be able to reduce power consumption of a display device on which a plurality of images are displayed and also prevent the degradation of display quality.

SUMMARY

The present disclosure provides an electronic device of which display quality is enhanced.

An embodiment of the inventive concept provides an electronic device including: a display panel including a plurality of pixels respectively connected to a plurality of data lines and a plurality of scan lines; a data driving circuit connected to the plurality of data lines; a scan driving circuit connected to the plurality of scan lines; and a driving controller generating image data, and controlling the data driving circuit and the scan driving circuit to display a plurality of frames at a first frequency on the display panel based on the image data, wherein at least one of the plurality of frames includes an effective interval during which an image is transmitted, a blanking interval during which the image is not transmitted, and a refresh interval operating at a second frequency different from the first frequency.

In an embodiment, the second frequency may be higher than the first frequency.

In an embodiment, the refresh interval may be provided in plural, and the plurality of refresh intervals may be provided after the blanking interval.

In an embodiment, the driving controller may determine a number of the plurality of refresh intervals based on a time between a blanking interval of a previous frame and an effective interval of a current frame.

In an embodiment, the driving controller may adjust the second frequency based on the image data.

In an embodiment, the driving controller may calculate complexity of the image based on the image data and controls a period of the refresh interval based on the complexity.

In an embodiment, an (n+1)-th refresh interval (n is a positive integer) may be calculated based on an n-th refresh interval and an (n−1)-th refresh interval.

In an embodiment, a period of the refresh interval may be calculated using artificial intelligence.

In an embodiment, the artificial intelligence may include a convolutional neural network and a Long Short-Term Memory.

In an embodiment, the image data may include first image data having a first complexity and second image data having a second complexity higher than the first complexity, and a period of a first refresh interval, which is calculated based on the first complexity, is smaller than that of a second refresh interval, which is calculated based on the second complexity.

In an embodiment, a first length of an m-th frame (m is a positive integer) may be different from a second length of an (m+1)-th frame.

In an embodiment, a period of the effective interval of the m-th frame may be the same as a period of the effective interval of the (m+1)-th frame, and a period of a blanking interval of the m-th frame is different from a period of a blanking interval of the (m+1)-th frame.

In an embodiment, the electronic device may further include: a frame buffer configured to store the image data, wherein the stored image is transmitted in the refresh interval.

In an embodiment, the blanking interval may proceed after the effective interval, and the refresh interval may proceed after the blanking interval.

In an embodiment of the inventive concept, an electronic device includes: a display panel comprising a plurality of pixels connected respectively to a plurality of data lines and a plurality of scan lines, and displaying images during a plurality of frames; a data driving circuit connected to the plurality of data lines; a scan driving circuit connected to the plurality of scan lines; and a driving controller generating image data and controlling the data driving circuit and the scan driving circuit, wherein one of the plurality of frames includes a first effective interval operating at a first frequency and a first refresh interval operating at a second frequency higher than the first frequency.

In an embodiment, another of the plurality of frames may include a second effective interval operating at the first frequency and a plurality of second refresh intervals, each of which operating at a second frequency.

In an embodiment, another of the plurality of frames may include a third effective interval operating at the first frequency and a third refresh interval operating at a third frequency higher than the first frequency and lower than the second frequency.

In an embodiment, the driving controller may calculate complexity of the image based on the image data and controls a period of the first refresh interval base on the complexity.

In an embodiment, an (n+1)-th first refresh interval (n is a positive integer) may be calculated based on an n-th first refresh interval and an (n−1)-th first refresh interval.

In an embodiment, a period of the first refresh interval may be calculated using artificial intelligence.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Figure 1:
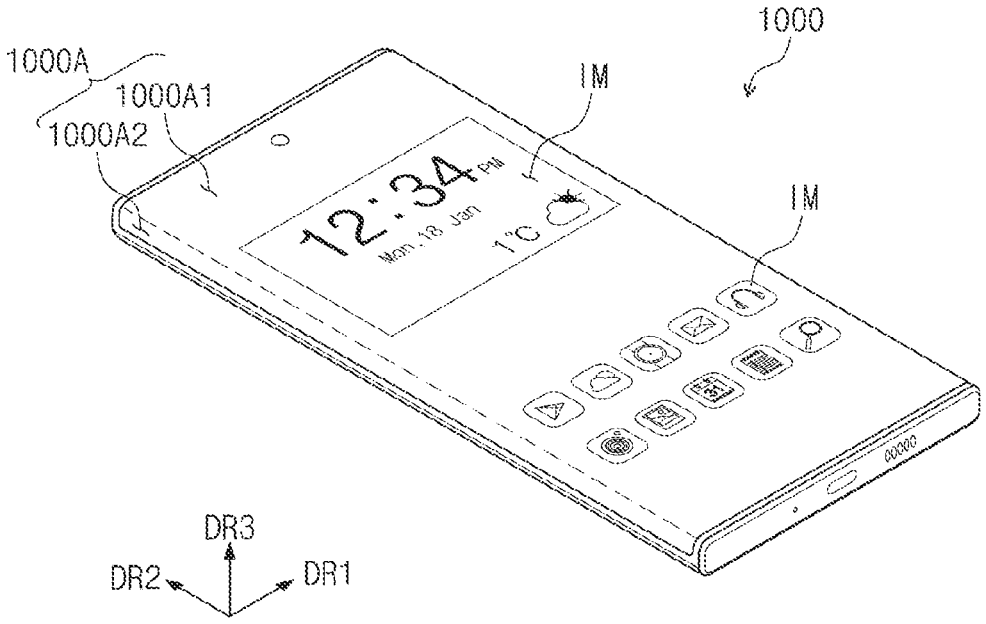
FIG. 1 is a perspective view of an electronic device according to an embodiment of the inventive concept.

It will be understood that when an element or layer is referred to as being "on", "connected to" or "coupled to" another element or layer, it can be directly on, connected or coupled to the other element or intervening third elements may be present.

Like reference numerals in the drawings refer to like elements. In addition, in the drawings, the thickness and the ratio and the dimension of the element are exaggerated for effective description of the technical contents. The term "and/or" includes any and all combinations of one or more of the associated items.

Terms such as first, second, and the like may be used to describe various components, but these components should not be limited by the terms. These terms are only used to distinguish one element from another. For instance, a first component may be referred to as a second component, or similarly, a second component may be referred to as a first component, without departing from the scope of the present disclosure. The singular expressions include plural expressions unless the context clearly dictates otherwise.

In addition, the terms such as "under", "lower", "on", and "upper" are used for explaining associations of items illustrated in the drawings. It will be understood that the spatially relative terms are intended to encompass different orientations of the device in use or operation in addition to the orientation depicted in the figures.

It will be further understood that the terms "includes" and/or "including", when used in this specification, specify the presence of stated features, integers, steps, operations, elements, components or combinations thereof, but do not preclude the presence or addition of one or more other features, integers, steps, operations, elements, components, or combinations thereof.

Unless otherwise defined, all terms (including technical and scientific terms) used herein have the same meaning as commonly understood by one of ordinary skill in the art to which example embodiments belong. In addition, it will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Hereinafter, embodiments of the inventive concept will be described with reference to the accompanying drawings.

FIG. 1 is a perspective view of an electronic device according to an embodiment of the inventive concept.

Referring to FIG. 1, the electronic device 1000 may include a large electronic device such as a television, a monitor, or an outdoor advertising billboard. In addition, the electronic device (1000) may be a small or medium-sized electronic device such as a personal computer, a notebook computer, a personal digital terminal, a vehicle navigator, a game console, a smartphone, a tablet, or a camera, etc. However, this is an example, and other electronic devices may be included without departing from the spirit of the inventive concept. In FIG. 1, the electronic device 1000 is illustrated as a mobile phone.

An active area 1000A may include a first display surface 1000A1 which is disposed parallel to a surface defined by a first direction DR1 and a second direction DR2 that intersects with the first direction DR1, and a second display surface 1000A2 extending from the first display surface 1000A1.

The electronic device 1000 may display an image IM towards a third direction DR3 in the active area 1000A. The third direction DR3 may be referred to as a thickness direction. The image IM may include a still image as well as a moving image. In FIG. 1, as an example of the image IM, a clock window and icons are illustrated. The active area 1000A in which the image IM 1000A is displayed may correspond to the front surface of the display device 1000.

In the present embodiment, a front surface (or an upper surface) and a rear surface (or a lower surface) of each constituent may be defined on the basis of a direction in which the image IM is displayed, The front surface and the rear surface may face each other in the third direction DR3 and the normal directions of the front surface and the rear surface may be parallel to the third direction DR3. In the present specification, the expression of "in a plan view" may mean when viewed from the third direction DR3.

The second display surface 1000A2 may be a surface extending from one side of the first display surface 1000A1 and bent in a direction different from a direction in which the first display surface 1000A1 extends. In addition, the second display surface 1000A2 may be provided in plural. In this case, the second display surfaces 1000A2 may extend from at least two sides of the first display surface 1000A1. In the active area 1000A, one first display surface 1000A1 and one to four second display surfaces 1000A2 may be defined. However, the shape of the active area 1000A is not limited thereto, and only one first display surface 1000A1 may be defined in the active area 1000A.

Figure 2:
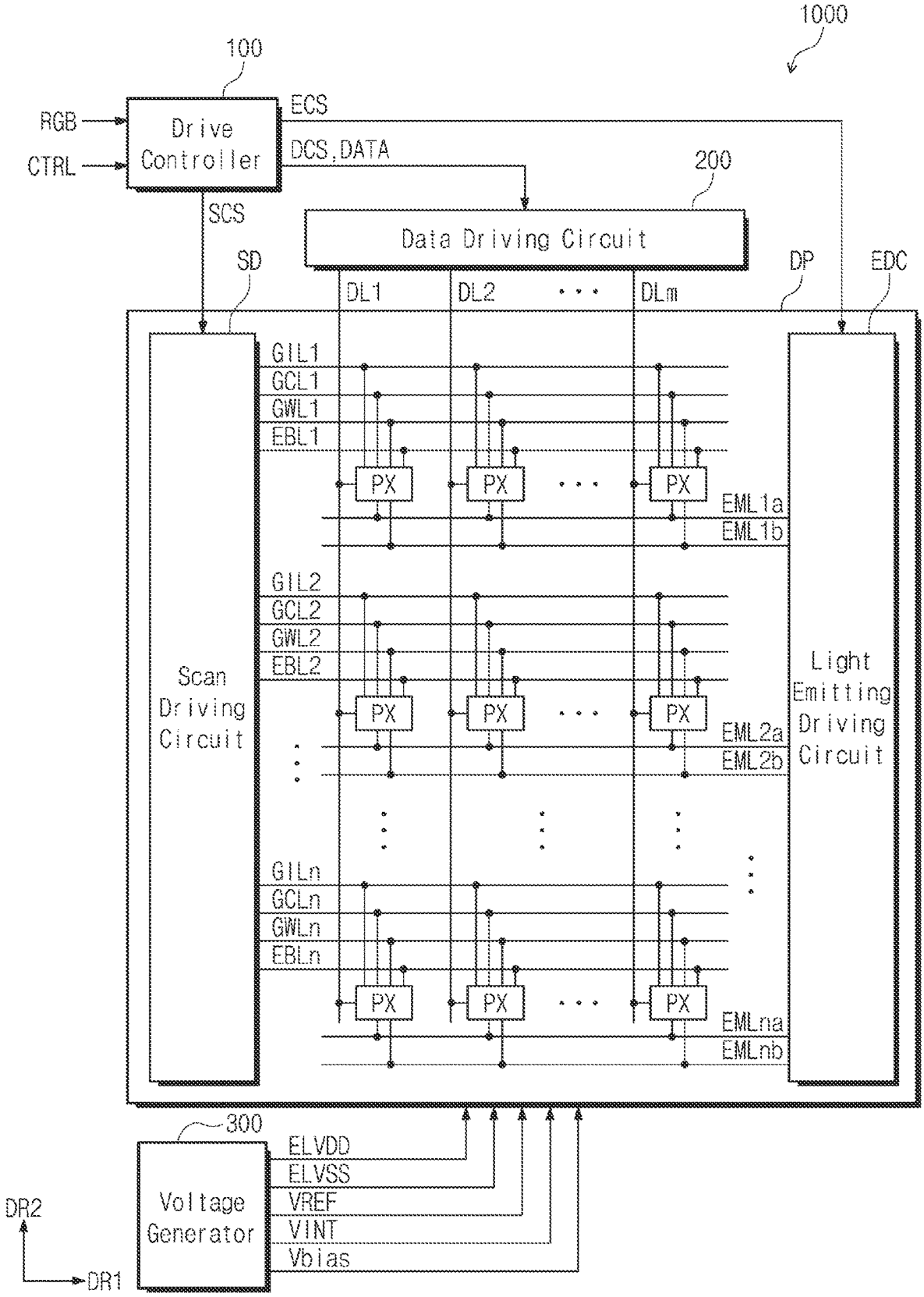
FIG. 2 is a block diagram of an electronic device according to an embodiment of the inventive concept.

FIG. 2 is a block diagram of an electronic device according to an embodiment of the inventive concept.

The driving controller 100 may receive an image signal RGB and a control signal CTRL. The driving controller 100 may generate image data DATA obtained by converting a data format of the image signal RGB so as to satisfy the interface specification with a data driving circuit 200. The driving controller 100 may output a scan control signal SCS, a data control signal DCS, and a light emitting control signal ECS.

The data driving circuit 200 may receive the data control signal DCS and the image data DATA from the driving controller 100. The data driving circuit 200 may convert the image data DATA into data signals and outputs the data signals to a plurality of data lines DL1 to DLm to be described later. The data signals may be analog voltages corresponding to grayscale values of the image data DATA.

A voltage generator 300 may generate voltages required for an operation of a display panel DP. In an embodiment of the inventive concept, the voltage generator 300 may generate a first driving voltage ELVDD, a second driving voltage ELVSS, a reference voltage VREF, an initialization voltage VINT, and a bias voltage Vbias. However, this is an example, and the voltage generator 300 may not generate at least one voltages among the first driving voltage ELVDD, the second driving voltage ELVSS, the reference voltage VREF, the initialization voltage VINT, and the bias voltage Vbias, or further generate other voltages in another embodiment.

The display panel DP according to an embodiment of the inventive concept may be an emissive display panel and is not particularly limited thereto. For example, the display panel DP may include an organic light emitting display panel, a quantum dot light emitting display panel, a micro LED display panel, and a nano LED display panel, etc. A light emitting layer of the organic light emitting display panel includes an organic light emitting material. A light emitting layer of the quantum dot light emitting display panel may include a quantum dot, a quantum rod, and the like. A light emitting layer of the micro LED display panel may include a micro LED. A light emitting layer of the nano LED display panel may include a nano LED.

The display panel DP may include scan lines GIL1 to GILn, GCL1 to GCLn, GWL1 to GWLn, and EBL1 to EBLn, light emission control lines EML1*a* to EMLna and EML1*b* to EMLnb, data lines DL1 to DLm, and pixels PX.

The display panel DP may further include a scan driving circuit SD and a light emission driving circuit EDC. In an embodiment of the inventive concept, the scan driving circuit may be arranged in a first side of the display panel DP. The scan lines GIL1 to GILn, GCL1 to GCLn, GWL1 to GWLn, and EBL1 to EBLn may extend in the first direction DR1 from the scan driving circuit SD.

The light emission driving circuit EDC may be arranged in a second side of the display panel DP. The light emission control lines EML1*a* to EMLna and EML1*b* to EMLnb may extend in the opposite direction to the first direction DR1 from the light emission driving circuit EDC.

The scan lines GIL1 to GILn, GCL1 to GCLn, GWL1 to GWLn, and EBL1 to EBLn and the light emission control lines EML1*a* to EMLna and EML1*b* to EMLnb may be spaced apart from each other in the second direction DR2. The data lines DL1 to DLm may extend from the data driving circuit 200 in the opposite direction to the second direction DR2 and be arranged to be spaced apart from each other in the first direction DR1.

In the example shown in FIG. 2, the scan driving circuit SD and the light emission driving circuit EDC may be arranged to face each other with the pixels PX interposed therebetween, but the embodiment of the inventive concept is not limited thereto. For example, the scan driving circuit SD and the light emission driving circuit EDC may be disposed to be adjacent to any one of the first side and the second side of the display panel DP. In an embodiment, the scan driving circuit SD and the light emission driving circuit EDC may be integrated into one circuit.

The plurality of pixels PX are respectively electrically connected to the scan lines GIL1 to GILn, GCL1 to GCLn, GWL1 to GWLn, and EBL1 to EBLn, the light emission control lines EML11 to EML2*na* and EML1*b* to EMLnb, and the data lines DL1 to DLm. Each of the plurality of pixels PX may be electrically connected to four scan lines and two light emission control lines. For example, as shown in FIG. 1, the pixels in the first row may be connected to the scan lines GILL GCL1, and GWL1 and the light emission control line EML1. In addition, the pixels in the second row may be connected to the scan lines GIL2, GCL2, and GWL2 and the light emission control line EML2.

Each of the plurality of pixels PX may receive a first driving voltage ELVDD, a second driving voltage ELVSS, the reference voltage VREF, the initialization voltage VINT, and the bias voltage Vbias.

The scan driving circuit SD may receive the scan control signal SCS from the driving controller 100. In response to the scan control signal SCS, the scan driving circuit SD may output the scan signals to the scan lines GIL1 to GILn, GCL1 to GCLn, GWL1 to GWLn, and EBL1 to EBLn.

In response to the light emission control signal ECS from the driving controller 100, the light emission driving circuit EDC may output the light emission control signals to the light emission control lines EML1*a* to EMLna and EML1*b* to EMLnb.

The driving controller 100 according to an embodiment of the inventive concept may determine a driving frequency, and control the data driving circuit 200, the scan driving circuit SD, and the light emission driving circuit EDC according to the determined driving frequency.

Figure 3:
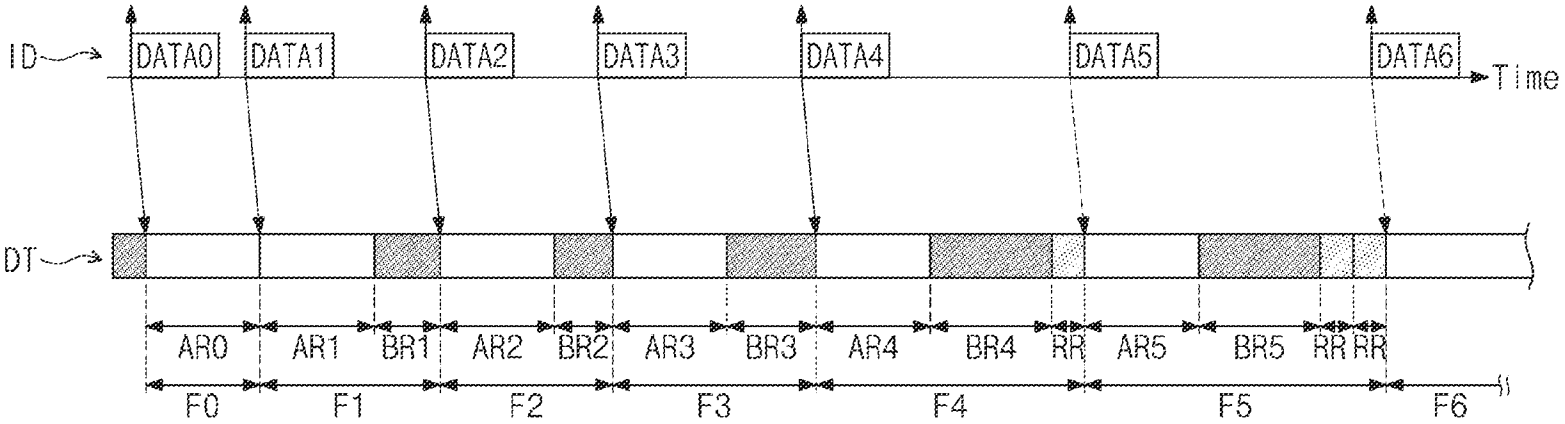
FIG. 3 is a timing diagram illustrating driving of an electronic device according to an embodiment of the inventive concept.

FIG. 3 is a timing diagram illustrating driving of an electronic device according to an embodiment of the inventive concept.

FIG. 3 shows timings of input data ID and a display timing DT.

Referring to FIGS. 2 and 3, the input data ID may be the image data DATA transmitted from the driving controller 100 to the driving circuit 200 which is illustrated along a time axis. The display timing DT is frames of the image IM (see FIG. 1) displayed on the display panel DP which are illustrated along the time axis.

The driving controller 100 may control the display panel DP to display an image during a frame based on the image data DATA.

The electronic device 1000 may synchronize a timing of a frame in a graphic processing device included in the electronic device 1000 with a timing of a frame of the display panel DP. The display panel DP may operate in a variable frequency mode in which the frequency of displaying an image is varied. In a specific operation environment such as displaying a still image, the power consumption of the electronic device 1000 may be reduced because an operation frequency of the electronic device 1000 is low.

A plurality of frames F0 to F6 may respectively correspond to a plurality of image data DATA0 to DATA6. The plurality of frames F0 to F6 may be an interval in which the image IM (see FIG. 1) is displayed on the basis of the plurality of image data DATA0 to DATA6.

First image data DATA0 may be provided to the display panel DP. A first frame F0 may be an interval during which the image IM (see FIG. 1) is displayed on the basis of the first image data DATA0. The first frame F0 may include a first effective interval AR0 operating at a first frequency. The first effective interval AR0 may be an interval during which the first image data DATA0 is transmitted and displayed on the display panel DP.

Second image data DATA1 may be provided to the display panel DP. The second image data DATA1 may be provided after the first image data DATA0 is provided to the display panel DP. A second frame F1 may be an interval during which the image IM (see FIG. 1) is displayed on the basis of the second image data DATA1. The second frame F1 may include a second effective interval AR1 during which the second image data DATA1 is transmitted and displayed on the display panel DP. The second effective interval AR1 may operate at a second frequency. The respective periods of the second effective interval AR1 and the first effective interval AR0 may be the same.

When new image data is not received after the effective interval, there may be a blanking interval. The second frame F1 may further include a second blanking interval BR1. The second blanking interval BR1 may be an interval during which the second image data DATA1 is not transmitted and displayed on the display panel DP. The second blanking interval BR1 may proceed after the second effective interval AR1. The period of the second blanking interval BR1 may be a time period during which third image data DATA2 is received.

The third image data DATA2 may be provided to the display panel DP. The third image data DATA2 may be provided after the second image data DATA1 is provided to the display panel DP. A third frame F2 may be an interval during which the image IM (see FIG. 1) is displayed on the basis of the third image data DATA2.

The third frame F2 may include a third effective interval AR2 during which the third image data DATA2 is transmitted and displayed on the display panel DP, and a third blanking interval BR2 during which the third image data DATA2 is not transmitted and displayed. A third effective interval AR2 may operate at the first frequency. The respective periods of the third effective interval AR2 and the second effective interval AR1 may be the same. The period of the third blanking interval BR2 may be a time period during which fourth image data DATA3 is received.

The fourth image data DATA3 may be provided to the display panel DP. The fourth image data DATA3 may be provided after the third image data DATA2 is provided to the display panel DP. A fourth frame F3 may be an interval during which the image IM (see FIG. 1) is displayed on the basis of the fourth image data DATA3. The length of the fourth frame F3 may be different from that of the third frame F2. For example, the length of the fourth frame F3 may be longer than that of the third frame F2.

The fourth frame F3 may include a fourth effective interval AR3 during which the fourth image data DATA3 is transmitted and a fourth blanking interval BR3 during which the fourth image data DATA3 is not transmitted and displayed on the display panel DP. The fourth effective interval AR3 may operate at the first frequency. The respective periods of the fourth effective interval AR3 and the third effective interval AR2 may be the same. The period of the fourth blanking interval BR3 may be a time period during which fifth image data DATA4 is received. The respective periods of the fourth blanking interval BR3 and the third blanking interval BR2 may be different from each other. For example, the period of the fourth blanking interval BR3 may be larger than that of the third blanking interval BR2. The electronic device 1000 may adjust the period of the blacking interval to control the display panel DP to operate in the variable frequency mode.

The fifth image data DATA4 may be provided to the display panel DP. The fifth image data DATA4 may be provided after the fourth image data DATA3 is provided to the display panel DP. A fifth frame F4 may be an interval during which the image IM (see FIG. 1) is displayed on the basis of the fifth image data DATA4.

The fifth frame F4 may include a fifth effective interval AR4 during which the fifth image data DATA4 is transmitted and displayed on the display panel DP and a fifth blanking interval BR4 during which the fifth image data DATA4 is not transmitted and displayed on the display panel DP. The fifth effective interval AR4 may operate at the first frequency. The respective periods of the fifth effective interval AR4 and the fourth effective interval AR3 may be the same. The respective periods of the fifth blanking interval BR4 and the fourth blanking interval BR3 may be different from each other. For example, the period of the fifth blanking interval BR4 may be larger than that of the fourth blanking interval BR3. The period of the fifth blanking interval BR4 may be a maximum blanking interval period that the display panel DP may provide.

When new image data is not received after the maximum period of the blanking interval, a refresh interval may proceed. The fifth frame F4 may further include a refresh interval RR. The refresh interval RR may proceed after the fifth blanking interval BR4. The refresh interval RR may operate at the second frequency different from the first frequency. The second frequency may be higher than the first frequency.

The electronic device 1000 may further include a frame buffer configured to store the image data DATA. The stored image data DATA may be transmitted during the refresh interval RR.

The period of the refresh interval RR may be shorter than that of each of the fifth effective interval AR4 and the fifth blanking interval BR4. When sixth image data DATA5 is provided in the refresh interval RR, collision with the fifth frame F4 and the sixth image data DATA5 may be minimized.

According to the inventive concept, because the refresh interval RR has a shorter period than that of each of the fifth effective interval AR4 and the fifth blanking interval BR4, delay of a timing at which the next image data DATA is displayed may be minimized. In other words, generation of a jitter, which may be generated by the timing delay, may be minimized. Accordingly, the electronic device 1000 having improved display quality may be provided.

Sixth image data DATA5 may be provided to the display panel DP. The sixth image data DATA5 may be provided after the fifth image data DATA4 is provided to the display panel DP. A sixth frame F5 may be an interval during which the image IM (see FIG. 1) is displayed on the basis of the sixth image data DATA5.

The sixth frame F5 may include a sixth effective interval AR5 during which the sixth image data DATA5 is transmitted and displayed on the display panel DP, a sixth blanking interval BR5 in which the sixth image data DATA5 is not transmitted and displayed on the display panel DP, and a plurality of refresh intervals RR. The sixth effective interval AR5 may operate at the first frequency. The respective periods of the sixth effective interval AR5 and the fifth effective interval AR4 may be the same. The respective periods of the sixth blanking interval BR5 and the fifth blanking interval BR4 may be the same. For example, the respective periods of the sixth blanking interval BR5 and the fifth blanking interval BR4 may be a maximum blanking interval period that the display panel DP can provide.

The refresh interval RR in the sixth frame F5 may be provided in plural. For example, the number of the plurality of refresh intervals RR may be 2. The plurality of refresh intervals RR may proceed after the sixth blanking interval BR5. The plurality of refresh intervals RR may be a time period during which seventh image data DATA6 is received. The driving controller 100 of the electronic device 1000 may adjust the number of the plurality of refresh intervals RR to control the display panel DP to operate in the variable frequency mode.

Each of the plurality of refresh intervals RR may operate at the second frequency greater than the first frequency. In other words, the period of each of the plurality of refresh intervals RR may be shorter than that of each of the sixth effective interval AR5 and the sixth blanking interval BR5. When the seventh image data DATA6 is provided in the plurality of refresh intervals RR, collision with the sixth frame F5 and the seventh image data DATA6 may be minimized.

According to the inventive concept, because the refresh interval RR has a shorter period than that of each of the sixth effective interval AR5 and the sixth blanking interval BR5, delay of a timing at which the next image data DATA is displayed may be minimized. In other words, generation of a jitter, which may be generated by the timing delay, may be minimized. Accordingly, the electronic device 1000 having improved display quality may be provided.

The seventh image data DATA6 may be provided to the display panel DP. The seventh image data DATA6 may be provided after the sixth image data DATA5 is provided to the display panel DP. A seventh frame F6 may be an interval during which the image IM (see FIG. 1) is displayed on the basis of the seventh image data DATA6. Whether the seventh frame F6 includes an effective interval, a blanking interval, a refresh interval or the like may be determined according to an input time of the image data DATA to be provided during a next frame following the seventh frame F6.

Figure 4:
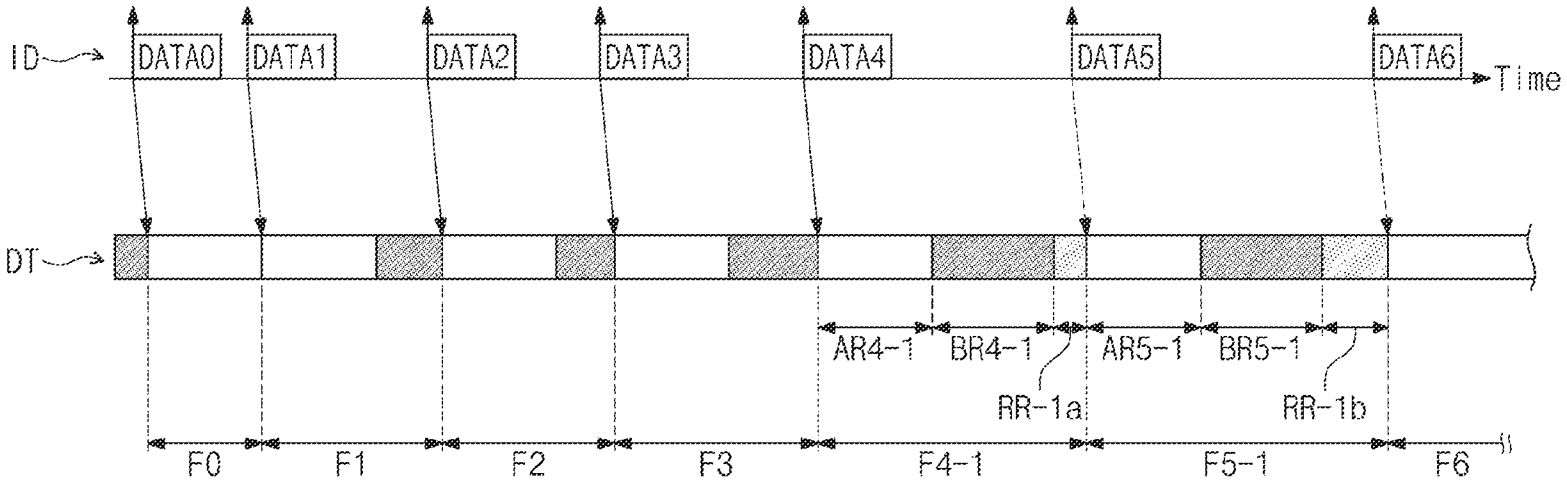
FIG. 4 is a timing diagram illustrating driving of an electronic device according to an embodiment of the inventive concept.

FIG. 4 is a timing diagram illustrating driving of an electronic device according to an embodiment of the inventive concept. In description about FIG. 4, like reference numerals are given to the elements described in relation to FIG. 3, and descriptions thereabout will be omitted.

Referring to FIGS. 2 and 4, the fifth image data DATA4 may be provided to the display panel DP. The fifth image data DATA4 may be provided after the fourth image data DATA3 is provided to the display panel DP. A fifth frame F4-1 may be an interval during which the image IM (see FIG. 1) is displayed on the basis of the fifth image data DATA4.

The fifth frame F4-1 may include a fifth effective interval AR4-1 during which the fifth image data DATA4 is transmitted and displayed on the display panel DP, a fifth blanking interval BR4-1 during which the fifth image data DATA4 is not transmitted and displayed on the display panel DP, and a first refresh interval RR-1*a*. The fifth effective interval AR4-1 may operate at the first frequency. The first refresh interval RR-la may operate at the second frequency different from the first frequency. The period of the fifth blanking interval BR4-1 may be a maximum blanking interval period that the display panel DP may provide. The second frequency may be higher than the first frequency.

The period of the first refresh interval RR-1*a* may be shorter than that of each of the fifth effective interval AR4-1 and the fifth blanking interval BR4-1. When the sixth image data DATA5 is provided in the first refresh interval RR-1*a*, collision with the fifth frame F4-1 and the sixth image data DATA5 may be minimized.

According to the inventive concept, because the first refresh interval RR-1*a* has shorter period than that of the fifth effective interval AR4-1 and the fifth blanking interval BR4-1, delay of a timing at which the next image data DATA is displayed may be minimized. In other words, generation of a jitter, which may be generated by the timing delay, may be minimized. Accordingly, the electronic device 1000 having improved display quality may be provided.

The sixth image data DATA5 may be provided to the display panel DP. The sixth image data DATA5 may be provided after the fifth image data DATA4 is provided to the display panel DP. The sixth frame F5 may be an interval during which the image IM (see FIG. 1) is displayed on the basis of the sixth image data DATA5.

The sixth frame F5 may include a sixth effective interval AR5-1 during which the sixth image data DATA5 is transmitted and displayed on the display panel DP, a sixth blanking interval BR5-1 in which the sixth image data DATA5 is not transmitted and displayed on the display panel DP, and a second refresh intervals RR-1*b*. The sixth effective interval AR5-1 may operate at the first frequency. The second refresh interval RR-1*b* may operate at a third frequency different from the first frequency. The period of the sixth blanking interval BR5-1 may be the same as that of the fifth blanking interval BR4-1. The period of the sixth blanking interval BR5-1 may be a maximum blanking interval period that the display panel DP may provide. The third frequency may be higher than the first frequency and lower than the second frequency.

The driving controller 100 may adjust the frequency of the refresh interval on the basis of the image data DATA. For example, the driving controller 100 may adjust the frequency of the fifth refresh interval RR-1*a* to the second frequency on the basis of the fifth image data DATA4, and adjust the frequency of the sixth refresh interval RR-1*b* to the third frequency on the basis of the sixth image data DATA5.

According to the inventive concept, the period of the refresh interval RR is determined according to the image data DATA to minimize delay of a timing at which the next image data DATA is displayed. In other words, generation of a jitter, which may be generated by the timing delay, may be minimized. Accordingly, the electronic device 1000 having improved display quality may be provided.

Figure 5:
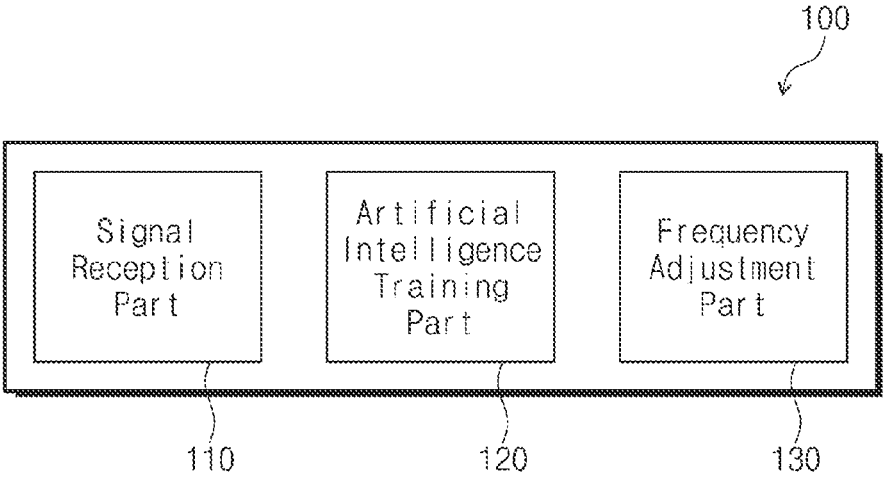
FIG. 5 is a block diagram of a driving controller according to an embodiment of the inventive concept.

FIG. 5 is a block diagram of a driving controller according to an embodiment of the inventive concept.

Referring to FIGS. 2 and 5, the driving controller 100 may include a signal reception part 110, an artificial intelligence training part 120, and a frequency adjustment part 130.

The signal reception part 110 may receive an image signal RGB and a control signal CTRL from the graphic processing device.

The artificial intelligence training part 120 may include a learning model. The learning model may include artificial intelligence configured to calculate the complexity of an image on the basis of the image data DATA. The artificial intelligence may mean artificial intelligence or methodology for making the artificial intelligence, and machine learning may mean methodology for defining various issues dealt with in the field of artificial intelligence and solving the various issues. The machine learning may be defined as an algorithm that enhances the performance of a certain task through a steady experience with the task.

The artificial intelligence may include neural network learning. The neural network learning may be designed to simulate human cerebral structure on a learning model. A deep neural network is one of models used in the machine learning, and may mean a whole model of problem-solving ability, which is composed of artificial neurons (nodes) that provide a network by combining synapses. The deep neural network may be defined by a connection pattern between neurons in different layers, a learning process for updating model parameters, and an activation function for generating an output value.

The deep neural network may include an input layer, an output layer, and at least on hidden layer. Each layer may include one or more neurons, and the deep neural network may include synapses that link neurons to neurons. In the deep neural network, each neuron may output a function value of the activation function for input signals, weights, and deflections input through the synapses.

The deep neural network may be trained according to supervised learning. The purpose of the supervised learning may be to find a predetermined answer through an algorithm. Accordingly, the deep neural network based on the supervised learning may include a type for inferring a function from training data. Labeled samples may be used for training in the supervised learning. When the training data is input to the deep neural network, the labeled samples may mean target output values having to be inferred by the deep neural network.

The algorithm is to receive a series of training data and target output values corresponding thereto, and find errors through training for comparing actual output values and target output values for the input data, and the algorithm may be corrected on the basis of the training result.

The neural network training may be performed by a convolutional neural network and a Long Short-Term Memory (LSTM). However, this is an example, and the neural network training according to an embodiment of the inventive concept is not limited thereto. For example, the neural network training may further include various algorithms.

Figure 7:
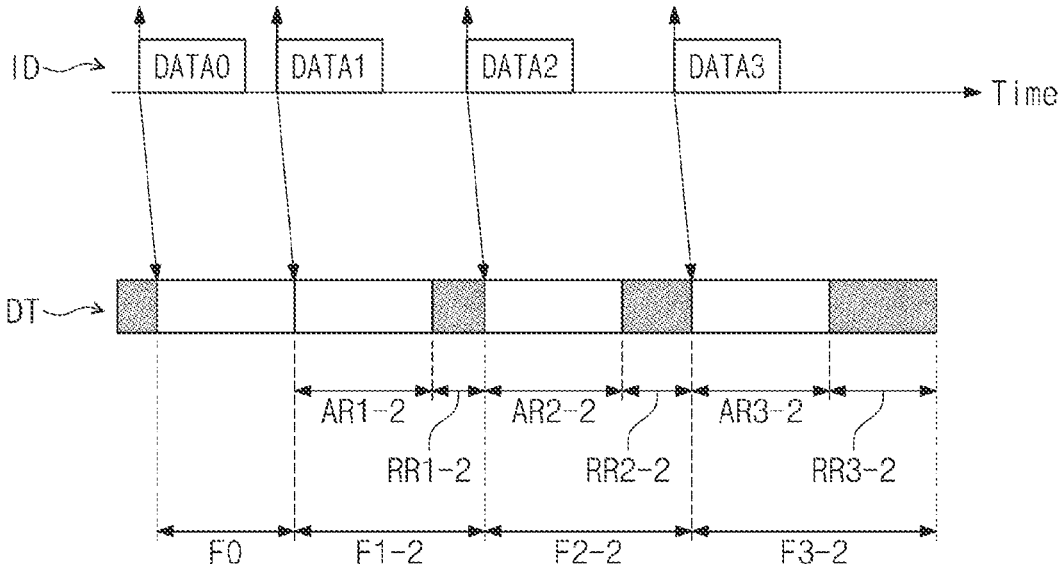
FIG. 7 is a timing diagram illustrating driving of an electronic device according to an embodiment of the inventive concept.

The frequency adjustment part 130 may adjust the respective frequencies of the refresh intervals RR1-2, RR2-2, and RR3-2 (see FIG. 7). The frequency adjustment part 130 may adjust the frequencies on the basis of the complexity of the image IM (see FIG. 1), which is calculated in the artificial intelligence training part (120). The frequency adjustment part 130 may calculate the period of each of the refresh intervals RR1-2, RR2-2, and RR3-2 (see FIG. 7).

Figure 6A:
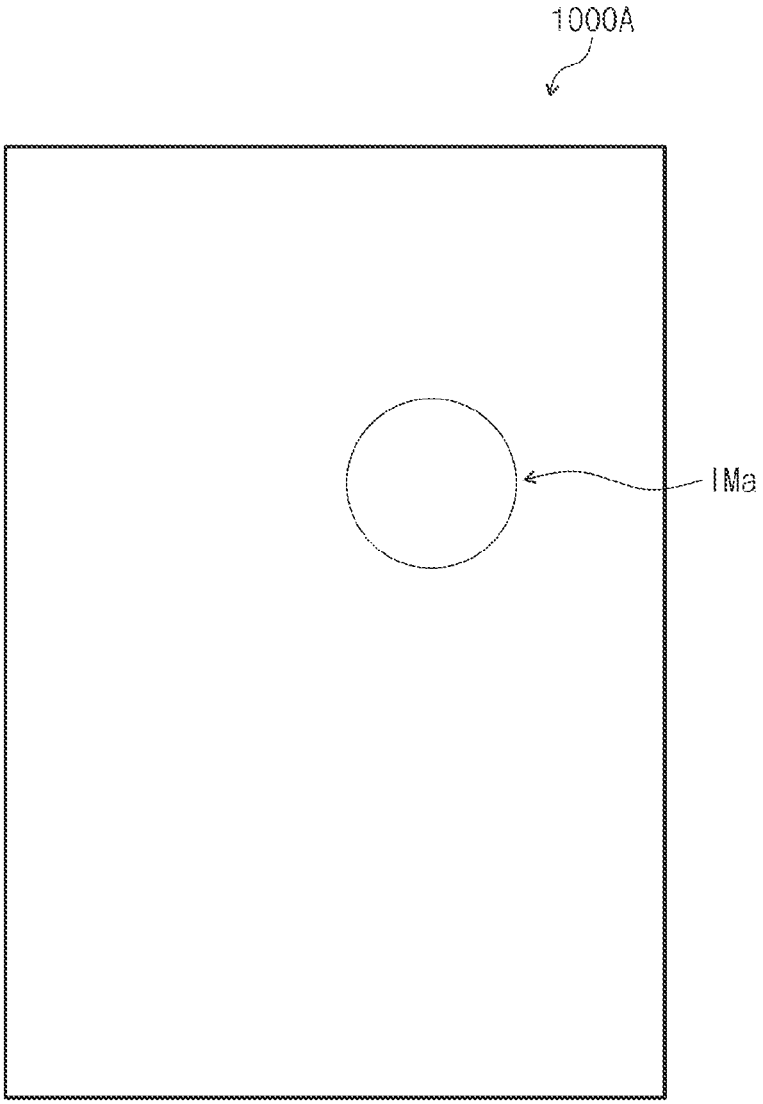
FIGS. 6A, 6B and 6C illustrate an active area according to an embodiment of the inventive concept.
Figure 6B:
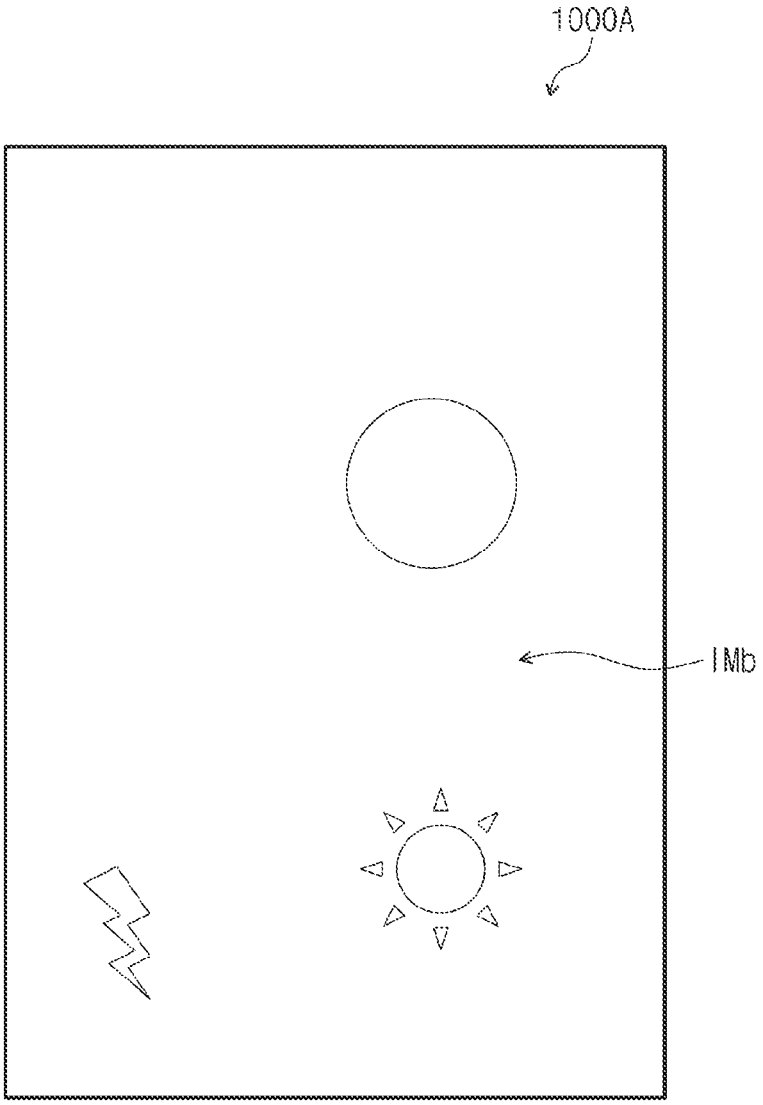
Figure 6C:
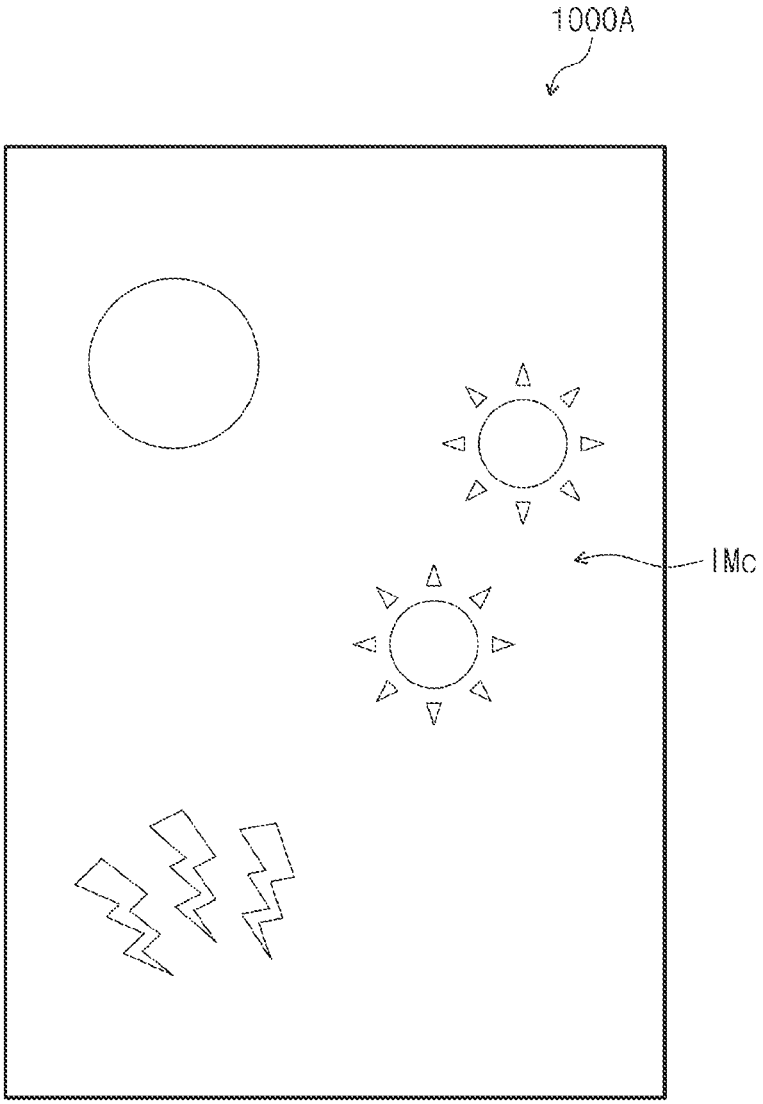

FIGS. 6A to 6C illustrate an active area according to an embodiment of the inventive concept.

Referring to FIG. 6A, an image IMa may be displayed in the active area 1000A. The image IMa may be displayed in one frame. For example, the image IMa may include an image showing a circle.

Referring to FIG. 6B, an image IMb may be displayed in the active area 1000A. The image IMb may be displayed in one frame. The image IMb may have the complexity higher than the image IMa of FIG. 6*a*. For example, the image IMb may include an image showing a circle, a sun shape, and a thunder shape.

Referring to FIG. 6C, an image IMc may be displayed in the active area 1000A. The image IMc may be displayed in one frame. The image IMc may have the complexity higher than that of each of the image IMa of FIG. 6A and the image IMb of FIG. 6B. For example, the image IMc may include an image showing one circle, two sun shapes, and three thunder shapes.

FIG. 7 is a timing diagram illustrating driving of an electronic device according to an embodiment of the inventive concept. In description about FIG. 7, like reference numerals are given to the elements described in relation to FIG. 3, and descriptions thereabout will be omitted.

Referring to FIGS. 2, 5 to 7, the second image data DATA1 may be provided to the display panel DP. A second frame F1-2 may be an interval in which the image IMa of FIG. 6A is displayed on the basis of the second image data DATA1.

The second frame F1-2 may include a second effective interval AR1-2 during which the second image data DATA1 is transmitted and displayed on the display panel DP, and a first refresh interval RR1-2. The second effective interval AR1-2 may operate at the first frequency. The first refresh interval RR1-2 may operate at the second frequency different from the first frequency. The second frequency may be higher than the first frequency. A blanking interval may not be included in the second frame F1-2 according to an embodiment of the inventive concept.

The artificial intelligence training part 120 may calculate the complexity of the image IMa on the basis of the second image data DATA1. The frequency adjustment part 130 may control the frequency of the first refresh interval RR1-2 on the basis of the complexity of the image IMa. In other words, the period of the first refresh interval RR1-2 may be calculated using the artificial intelligence.

For example, the second image DATA1 may be displayed for about 16 ms in the second effective interval AR1-2. The driving controller 100 may determine that the complexity of the image IMa is not relatively high on the basis of the second image data DATA1. The driving controller 100 may control the frequency of the first refresh interval RR1-2. The driving controller 100 may control the period of the first refresh interval RR1-2 to be about 1 ms on the basis of the complexity.

The period of the first refresh interval RR1-2 may set to have an optimal value by the driving controller 100. When the third image data DATA2 is provided in the first refresh interval RR1-2, collision with the second frame F1-2 and the third image data DATA2 may be minimized.

According to the inventive concept, the driving controller may calculate the complexity of the image IMa on the basis of the second image data DATA1. The period of the first refresh interval RR1-2 may be calculated to be an optimal value on the basis of the complexity. Delay of a timing at which the next image data DATA is displayed may be minimized. In other words, generation of a jitter, which may be generated by the timing delay, may be minimized. Accordingly, the electronic device 1000 having improved display quality may be provided.

The third image data DATA2 may be provided to the display panel DP. A third frame F2-2 may be an interval during which the image IMb of FIG. 6B is displayed on the basis of the third image data DATA2.

The third frame F2-2 may include a third effective interval AR2-2 during which the third image data DATA2 is transmitted and displayed on the display panel DP, and a second refresh interval RR2-2. The third effective interval AR2-2 may operate at the first frequency. The second refresh interval RR2-2 may be an interval during which the display panel DP may operate at the third frequency different from the first frequency and the second frequency.

The artificial intelligence training part 120 may calculate the complexity of the image IMb on the basis of the third image data DATA2. The complexity of the image IMb may be higher than that of the image IMa of FIG. 6A. The frequency adjustment part 130 may control the frequency of the second refresh interval RR2-2 on the basis of the complexity of the image IMb. In other words, the period of the second refresh interval RR2-2 may be calculated using the artificial intelligence. The period of the second refresh interval RR2-2 may be larger than that of the first refresh interval RR1-2.

For example, the third image DATA2 may be displayed for about 16 ms in the third effective interval AR2-2. The driving controller 100 may determine that the complexity of the image IMb is higher than that of the image IMa of FIG. 6A on the basis of the third image data DATA2. The driving controller 100 may control the frequency of the second refresh interval RR2-2. The driving controller 100 may control the period of the second refresh interval RR2-2 to be about 3 ms on the basis of the complexity.

The period of the second refresh interval RR2-2 may be set to have an optimal value by the driving controller 100. When the fourth image data DATA3 is provided in the second refresh interval RR2-2, collision with the third frame F2-2 and the fourth image data DATA3 may be minimized.

According to the inventive concept, the driving controller 100 may calculate the complexity of the image IMb on the basis of the third image data DATA2. The period of the second refresh interval RR2-2 may be calculated to be an optimal value on the basis of the complexity. Delay of a timing at which the next image data DATA is displayed may be minimized. In other words, generation of a jitter, which may be generated by the timing delay, may be minimized. Accordingly, the electronic device 1000 having improved display quality may be provided.

The fourth image data DATA3 may be provided to the display panel DP. A fourth frame F3-2 may be an interval during which the image IMc of FIG. 6C is displayed on the basis of the fourth image data DATA3.

The fourth frame F3-2 may include a fourth effective interval AR3-2 in which the fourth image data DATA3 is transmitted and displayed in the display panel DP, and a third refresh interval RR3-2. The fourth effective interval AR3-2 may operate at the first frequency. The third refresh interval RR3-2 may operate at a fourth frequency different from the first, second and third frequencies.

The artificial intelligence training part 120 may calculate the complexity of the image IMc on the basis of the fourth image data DATA3. The complexity of the image IMc may be higher than that of each of the image IMa of FIG. 6A and the image IMb of FIG. 6B. The frequency adjustment part 130 may control the frequency of the third refresh interval RR3-2 on the basis of the complexity of the image IMc. In other words, the period of the third refresh interval RR3-2 may be calculated using the artificial intelligence. The period of the third refresh interval RR3-2 may be larger than that of each of the first refresh interval RR1-2 and the second refresh interval RR2-2.

In addition, the driving controller 100 may use the refresh intervals of the previous frames in calculating the period of the refresh interval. An (n+1)-th refresh interval (n is a positive integer) may be calculated on the basis of an n-th refresh interval and an (n−1)-th refresh interval. In other words, the (n+1)-th refresh interval may satisfy Equation (1).

$$\text{Period of } (n+1)\text{-th refresh interval} = \text{period of } a*(n)\text{-th refresh interval} + \text{period of } (1-a)*(n-1)\text{-th refresh interval} \quad (1)$$

Here, a may be a variable for determining importance of the previous refresh intervals. For example, the third refresh interval RR3-2 may be calculated on the basis of the first refresh interval RR1-2 and the second refresh interval RR2-2.

For example, the fourth image data DATA3 may be displayed for about 16 ms in the fourth effective interval AR3-2. The driving controller 100 may determine that the complexity of the image IMc is higher than that of each of the image IMa of FIG. 6A and the image IMb of FIG. 6B on the basis of the fourth image data DATA3. The driving controller 100 may control the frequency of the third refresh interval RR3-2. The driving controller 100 may control the period of the third refresh interval RR3-2 to be about 7 ms on the basis of the complexity.

The period of the third refresh interval RR3-2 may be set to have an optimal value by the driving controller 100. When the next image data DATA is provided in the third refresh interval RR3-2, collision with the fourth frame F3-2 and the next image data DATA may be minimized.

According to the inventive concept, the driving controller 100 may calculate the complexity of the image IMc on the basis of the fourth image data DATA3. The period of the third refresh interval RR3-2 may be calculated to be an optimal value on the basis of the complexity. Delay of a timing at which the next image data DATA is displayed may be minimized. In other words, generation of a jitter, which may be generated by the timing delay, may be minimized. Accordingly, the electronic device 1000 having improved display quality may be provided.

While this inventive concept has been described with reference to exemplary embodiments thereof, it will be clear to those of ordinary skill in the art to which the inventive concept pertains that various changes and modifications may be made to the described embodiments without departing from the spirit and technical area of the inventive concept as defined in the appended claims and their equivalents. Thus, the scope of the inventive concept shall not be restricted or limited by the foregoing description, but be determined by the broadest permissible interpretation of the following claims.

According to the aforementioned, a frequency of a refresh interval may be higher than that of an effective interval. The period of the refresh interval may be reduced due to the higher refresh frequency, and delay of a timing at which next image data is displayed may be minimized. In other words, generation of a jitter, which may be generated by the timing delay, may be minimized. Accordingly, a display device having improved display quality may be provided.

Although the embodiments of the present inventive concept have been described, it is understood that the present inventive concept should not be limited to these embodiments but various changes and modifications can be made by one ordinary skilled in the art within the spirit and scope of the present inventive concept as hereinafter claimed.

What is claimed is:

1. An electronic device comprising:

a display panel comprising a plurality of pixels respectively connected to a plurality of data lines and a plurality of scan lines;

a data driving circuit connected to the plurality of data lines;

a scan driving circuit connected to the plurality of scan lines; and a driving controller generating image data, and controlling the data driving circuit and the scan driving circuit to display a plurality of frames at a first frequency on the display panel based on the image data, wherein at least one of the plurality of frames includes an effective interval during which an image is transmitted, a blanking interval during which the image is not transmitted, and a refresh interval operating at a second frequency different from the first frequency, and wherein an (n+1)-th refresh interval (n is a positive integer) is obtained based on an n-th refresh interval and an (n−1)-th refresh interval.

2. The electronic device according to claim 1, wherein the second frequency is higher than the first frequency.

3. The electronic device according to claim 1, wherein the refresh interval is provided in plural, and the plurality of refresh intervals are provided after the blanking interval.

4. The electronic device according to claim 3, wherein the driving controller determines a number of the plurality of refresh intervals based on a time between a blanking interval of a previous frame and an effective interval of a current frame.

5. The electronic device according to claim 1, wherein the driving controller adjusts the second frequency based on the image data.

6. The electronic device according to claim 1, where the driving controller obtains complexity of the image based on the image data and controls a period of the refresh interval based on the complexity.

7. The electronic device according to claim 6, wherein a period of the refresh interval is obtained using artificial intelligence.

8. The electronic device according to claim 7, wherein the artificial intelligence comprises a convolutional neural network and a Long Short-Term Memory.

9. The electronic device according to claim 6, wherein the image data comprises a first image data having a first complexity and a second image data having a second complexity higher than the first complexity, and a period of a first refresh interval, which is obtained based on the first complexity, is smaller than that of a second refresh interval, which is obtained based on the second complexity.

10. The electronic device according to claim 1, wherein a first length of an m-th frame (m is a positive integer) is different from a second length of an (m+1)-th frame.

11. The electronic device according to claim 10, wherein a period of the effective interval of the m-th frame is same as a period of the effective interval of the (m+1)-th frame, and a period of a blanking interval of the m-th frame is different from a period of a blanking interval of the (m+1)-th frame.

12. The electronic device according to claim 1, further comprising:

a frame buffer configured to store the image data, wherein the stored image is transmitted in the refresh interval.

13. The electronic device according to claim 1, wherein the blanking interval proceeds after the effective interval, and the refresh interval proceeds after the blanking interval.

14. An electronic device comprising:

a display panel comprising a plurality of pixels connected respectively to a plurality of data lines and a plurality of scan lines, and displaying images during a plurality of frames;

a data driving circuit connected to the plurality of data lines;

a scan driving circuit connected to the plurality of scan lines; and a driving controller generating image data and controlling the data driving circuit and the scan driving circuit, wherein one of the plurality of frames comprises a first effective interval operating at a first frequency and a first refresh interval operating at a second frequency higher than the first frequency, and wherein an (n+1)-th refresh interval (n is a positive integer) is obtained based on an n-th refresh interval and an (n−1)-th refresh interval.

15. The electronic device according to claim 14, wherein another of the plurality of frames comprises a second effective interval operating at the first frequency and a plurality of second refresh intervals each of which operating at a second frequency.

16. The electronic device according to claim 14, wherein another of the plurality of frames comprises a third effective interval operating at the first frequency and a third refresh interval operating at a third frequency higher than the first frequency and lower than the second frequency.

17. The electronic device according to claim 14, where the driving controller obtains complexity of the image based on the image data and controls a period of the first refresh interval base on the complexity.

18. The electronic device according to claim 17, wherein a period of the first refresh interval is obtained using artificial intelligence.

* * * * *